US005092830A

United States Patent [19]

Helseth

[11] Patent Number: 5,092,830

[45] Date of Patent: Mar. 3, 1992

[54] METHOD OF MANUFACTURING TWIST-TIE MATERIAL

[75] Inventor: James R. Helseth, Minnetonka, Minn.

[73] Assignee: Twist-Ease, Inc., Minneapolis, Minn.

[21] Appl. No.: 529,899

[22] Filed: May 29, 1990

Related U.S. Application Data

[62] Division of Ser. No. 392,766, Aug. 11, 1989, Pat. No. 4,948,202.

[51] Int. Cl.[5] ..... B31D 1/00; B65D 77/10

[52] U.S. Cl. ..... 493/352; 493/962; 24/30.5 T

[58] Field of Search ..... 24/30.5 R, 30.5 P, 30.5 T; 53/138 A; 493/361, 362, 363, 364, 365, 366, 367, 368, 369, 372, 962, 352; 83/40, 42, 44, 50

[56] References Cited

U.S. PATENT DOCUMENTS

| | | | |
|---|---|---|---|
| 1,441,359 | 1/1923 | Langston | 493/362 |
| 2,050,394 | 8/1936 | Straubel | 493/363 |
| 2,973,597 | 3/1961 | Powell | 24/30.5 T |
| 2,984,161 | 5/1961 | Cook et al. | 493/365 |
| 3,068,135 | 12/1962 | Bower | 24/30.5 T |
| 3,290,854 | 12/1966 | MacMurray | 24/30.5 T |
| 3,409,948 | 11/1968 | Goodwin | 24/30.5 T |
| 4,052,886 | 10/1977 | Buick . | |
| 4,539,237 | 9/1985 | Clayton | 24/30.5 R |
| 4,543,862 | 10/1985 | Levene et al. . | |
| 4,558,813 | 12/1985 | Richards . | |
| 4,621,732 | 11/1986 | Olson | 24/30.5 R |

*Primary Examiner*—Bruce M. Kisliuk
*Assistant Examiner*—John A. Marlott
*Attorney, Agent, or Firm*—Merchant, Gould, Smith, Edell, Welter & Schmidt

[57] ABSTRACT

A dispenser system for dispensing a plurality of twist-ties like closure devices 52 arranged in side-by-side alignment and attached at a second end 61 in sheets 50. The attached second ends 61 are crimped about a rod 51 which is inserted in slots 107 defined in side edges 102 of dispenser 100. A plurality of sheets 50 may selectively be inserted in dispenser 100. The dispenser also includes a cover 103 and a tie alignment block 106. The individual ties have a series of transverse perforations 53, 54 through the wire 55 and proximate the wire 55 to ensure ease of removal and ensure reference of the steel rule die 250 utilized in fabricating the tie 52. Fabrication of the sheets 50 includes taking a stock of uncut twist-tie material 201, advancing it into a cutting station 203 utilizing a steel rule die 250. Advancing the material repeating the cutting step which forms the second end 61 of the advanced sheet and then advancing the cut sheet 50 to a crimping station 205.

9 Claims, 6 Drawing Sheets

FIG. 1
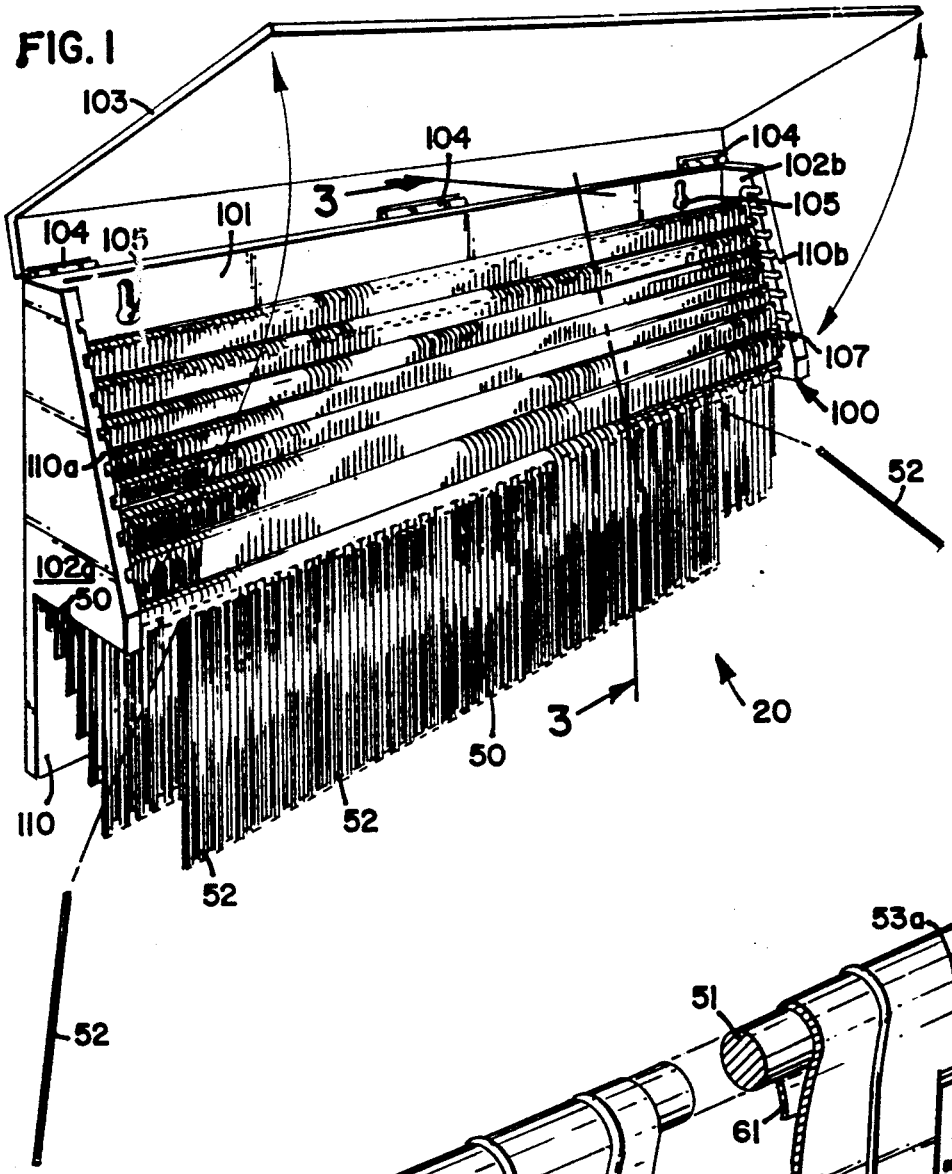
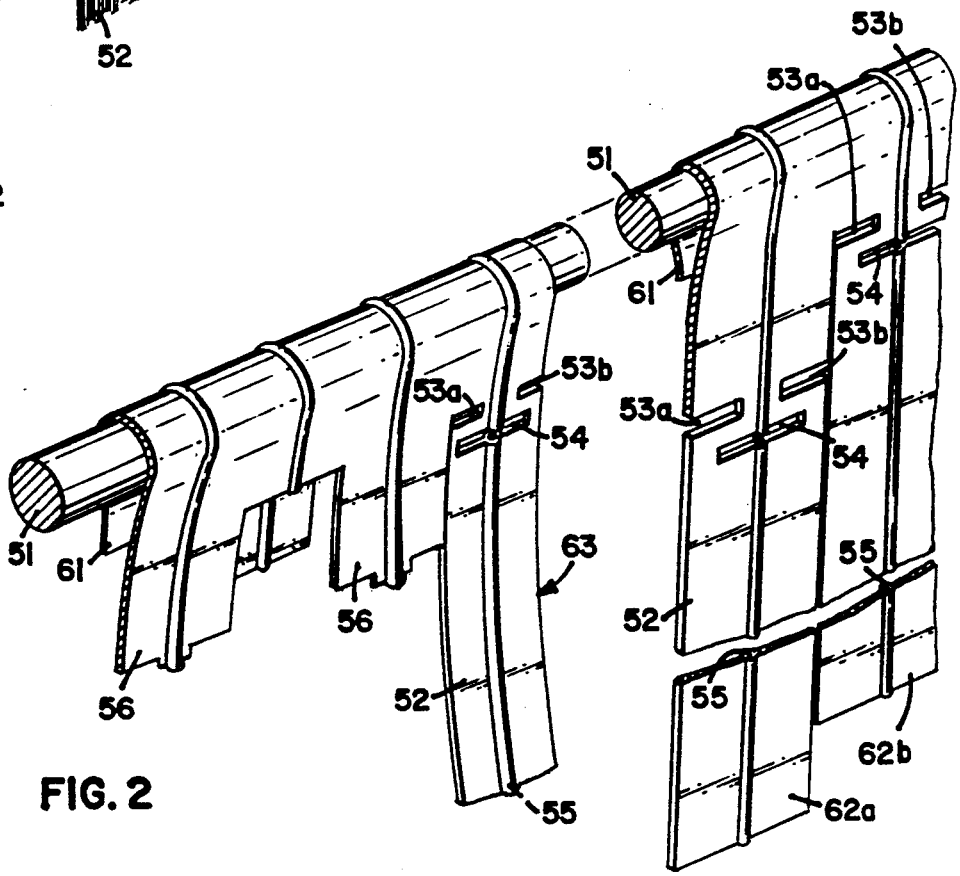
FIG. 2

250
210
212
213
211a
211b
6A 6A
6B 6B

FIG. 8a
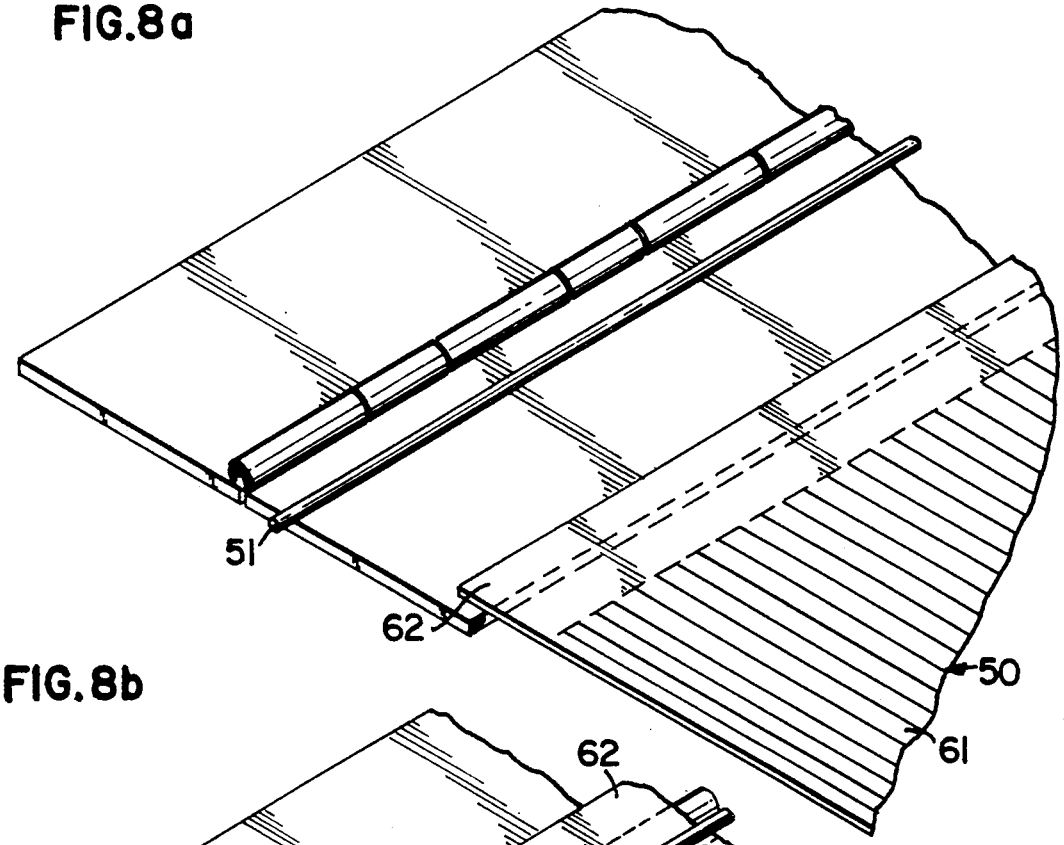
FIG. 8b
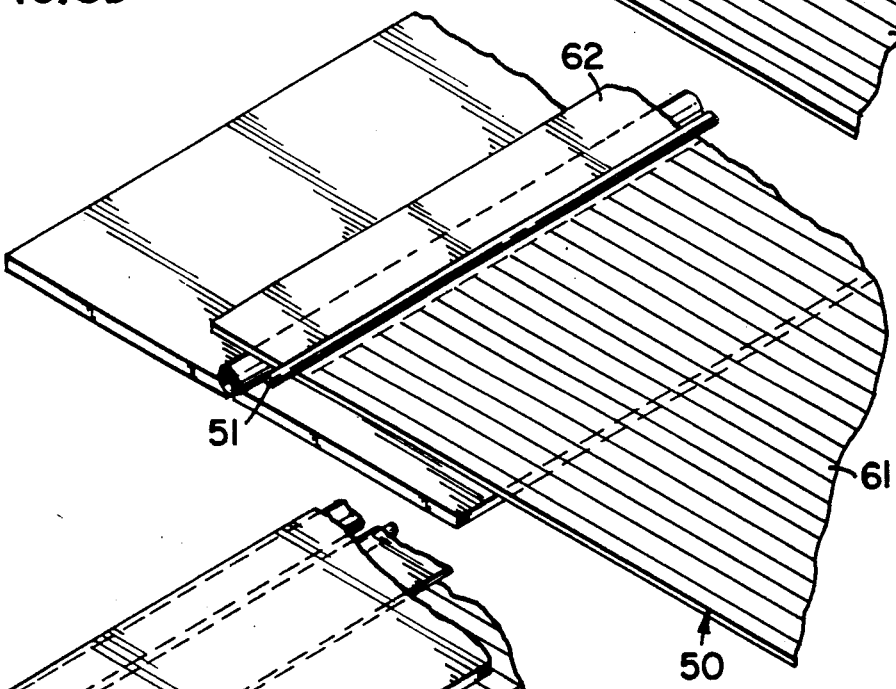
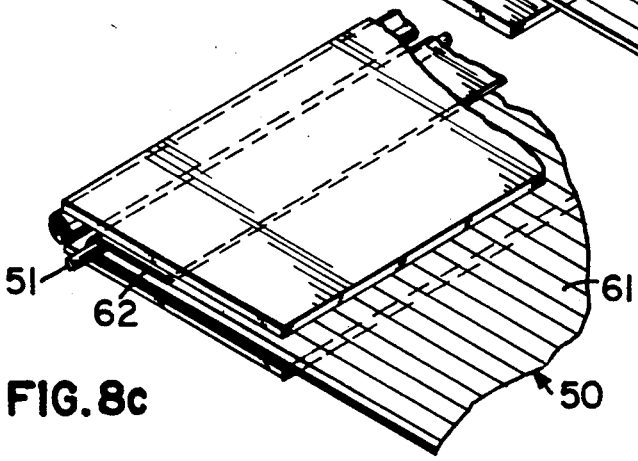
FIG. 8c

METHOD OF MANUFACTURING TWIST-TIE MATERIAL

This is a division of application Ser. No. 07/392,766, filed Aug. 11, 1989, now U.S. Pat. No. 4,948,202.

FIELD OF THE INVENTION

This invention relates generally to a dispenser system and more specifically to a dispenser system for twist-tie like closure devices for bags and the like.

BACKGROUND OF THE INVENTION

In grocery stores and other locations where produce and other foodstuffs are placed in bags for containment and carrying, generally a closure device is provided in order to temporarily close or seal the bag such that spillage of the contents does not occur. Typically, the closure device is either a twist-tie or a plastic lock device of the type manufactured by the Kwic-lok Company of Yakima, Wash.

Generally, a twist-tie is comprised of a length of wire embedded in a paper or plastic strip. The wire strength is such that the device may be easily looped about the open end of a bag or other object requiring closure or retention and the wire may then be twisted about itself. The wire is fully annealed with the gauge of wire commonly used being approximately 27 gauge. The paper or plastic wrapping serves the function of protecting the user of the device from sharp wire ends, facilitating ease of unfastening the device by urging the twisted wire into a larger pattern, and providing an aesthetic device.

The twist-tie itself is typically separated into individual component devices, or is arranged and configured in a side-by-side manner with other twist-ties. In the latter configuration, the twist-ties usually include perforations between the individual ties to provide for removal of the ties from one another.

Twist-ties, however, suffer a drawback when used in an environment wherein either a large number of people will be utilizing the supply of ties, for sanitary and entropy reasons, or a large number of ties are required to perform the task at hand. In the grocery market example, sanitary conditions are of utmost importance and so requires consideration in the manner of dispensing the ties. Further, spillage of ties is a concern for safety reasons among others. Heretofore, however, dispensing methods in such stores were limited to bulk dispensing of either individual ties within a container or bulk dispensing of ties in a side-by-side situation. In both cases, each consumer desiring a single twist-tie was forced to come into physical contact with a number of ties in addition to the tie which the consumer chose during the selection process. Additionally, if the side-by-side arrangement was utilized, selection of the twist-tie often required two hands, causing inconvenience to the consumer.

The second type of closure utilized is the "kwic-lock" type device referred to above. The plastic lock device is comprised of an integral "c" shaped portion and a tab portion. The device is installed on a bag by gathering the bag to form a neck (often accomplished in practice by holding the open end of the bag and spinning the lower end of the bag), placing the "c" portion of the lock against the neck, and twisting the tab portion. The twisting motion forces the jaws apart slightly and twists them into a position wherein the neck of the bag slips through the jaws and into the center of the "c". The neck of the bag is then secured.

Conversely, a twisting force applied to the tab portion when the device is inserted around the neck of the bag opens the jaws of the "c" portion slightly, while twisting the jaws. This allows the bag to slip through the jaws. The device is then released from the bag.

The drawbacks associated with the dispensing of this plastic lock device in a grocery type environment are similar to those set forth in regard to the twist-ties. The typical dispensing methods of the plastic lock device include bulk dispensing in a container or inserting the plastic lock device jaws onto a steel rod such that a number of devices are in a face-to-face arrangement with one another. Sanitary considerations are again a concern, since in both cases, the consumer is likely to contact a great number of devices in selecting the device for the consumer's personal use. Further, the relative ease of securing the device, the cost of the devices and the diversity of uses of twist-ties over kwic-lock style devices generates a demand for the twist-ties.

Therefore, there arises a need for a twist-tie dispenser system which enables consumers to select individual twist-tie style closure devices without handling additional twist-ties, other than the one chosen during the selection process. Further, there arises a need for a process to fabricate the twist-ties for such a dispenser.

SUMMARY OF THE INVENTION

The present invention provides a simple, relatively inexpensive, and yet reliable method and apparatus for fabricating and dispensing a plurality of selectively removable twist-tie style closure devices in a hygienic, organized, spill resistant fashion.

In the preferred embodiment fabrication process, twist-tie material in bulk web form (i.e., in large uncut rolls wherein the wires are embedded parallel to the rolls longitudinal length) is advanced beneath a cutting die which cuts the twist tie material between the wires and at a first end. The die also perforates the material transversely at a predetermined distance from the first end, preferably including a series of first perforations across the wires and a series of second perforations on either side of the wires, the second perforations being located proximate the first perforation. The web material is then advanced incrementally beneath the cutting die. The die then cuts a second sheet. This second cut/-perforation step forms the first end of the second sheet of twist-ties, while, inherently, at the same time forming the second end of the first sheet. The process of advancing and cutting/perforation is continued, forming additional sheets of twist-tie materials.

The individual sheets of twist-tie material are then advanced to a second stage wherein the uncut second end of the sheet is cooperatively connected to a rod, whereby the sheet is supported by the rod when the rod is supported at its two ends.

The rod supported sheets are then inserted into a dispenser system having opposing sides and an adjoining back wall. The dispenser utilizes a cover, for hygienic and sanitary reasons, which covers a portion of the tie sheets. The dispenser further comprises sheet alignment means, wherein the sheets are positioned away from the back wall of the dispenser so as to be easily selected by a user.

Therefore, according to one aspect of the invention, there is provided a dispenser system for twist-ties, comprising:

(a) a pre-cut sheet of twist-tie material, said sheet comprising a plurality of twist-ties in side-by-side alignment, said twist-ties having a first end and a second end, said twist-ties having a perforation proximate said second end;

(b) a rod, said pre-cut sheet of twist-tie material cooperatively engaging said rod, wherein a force applied to said first end of said twist-ties detaches said twist-ties at said perforation and said second end of said twist-tie remains engaged with said rod; and (c) a frame, said frame cooperatively engaging said rod and arranged and configured wherein said first ends of said twist-ties are exposed.

According to a further aspect of the invention, there is provided a dispenser as recited above, wherein said perforation includes a series of transverse perforations of said twist-ties. According to another aspect of the invention, there is provided a first perforation located proximate the transverse center of the twist-tie and a second perforation comprised of two perforations proximate the transverse edges of the twist-tie, said second perforation proximate said first perforation, whereby ripping of the twist-tie paper is facilitated so as to ease removal of the twist-tie from the dispenser system.

According to another aspect of the invention, there is provided a method for fabricating a sheet of twist-tie material for dispensing in a dispenser system, of the type wherein individual twist-ties may be removed, the method comprising the steps of:

(a) advancing a strip of uncut twist-tie material into a cutting station;

(b) perforating said twist-tie material at said first end in said cutting station;

(c) perforating said twist-tie material longitudinally so as to form longitudinal strips;

(d) perforating said twist-tie material transversely at a predetermined distance from said first end; and (e) advancing said strip of twist-tie material and repeating steps (a) through (d), wherein said perforating step at said first end creates a second end of the advanced twist-tie material.

According to a further aspect of the invention, there is provided a method as recited above, further comprising the step of crimping the second ends of said cut strips of twist-tie material about a rod.

While the invention will be described with respect to a preferred embodiment configuration and with respect to particular components used therein, it will be understood that the invention is not to be construed as limited in any manner by either such configurations or components described herein. Variations of the invention will become apparent to those skilled in the art upon a more detailed description of the invention.

These and various other advantages and features which characterize the invention are pointed out with particularity in the claims annexed hereto and forming a part hereof. However, for a better understanding of the invention, its advantages and objectives obtained by its use, reference should be had to the Drawing which forms a further part hereof and to the accompanying descriptive matter, in which there is illustrated and described a preferred embodiment of the invention.

DESCRIPTION OF THE DRAWING

Referring to the Drawing, wherein like numerals represent like parts throughout the several views:

FIG. 1 is a perspective view of a preferred embodiment twist-tie dispenser constructed according to the principles of the present invention;

FIG. 2 is an enlarged perspective view of a portion of a dispensing sheet 50 of FIG. 1;

FIGS. 8A, 8B, and 8C diagramatically illustrate a second embodiment of crimping station 205 of FIG. 4.

DETAILED DESCRIPTION OF THE PREFERRED EMBODIMENT

Figure 3:
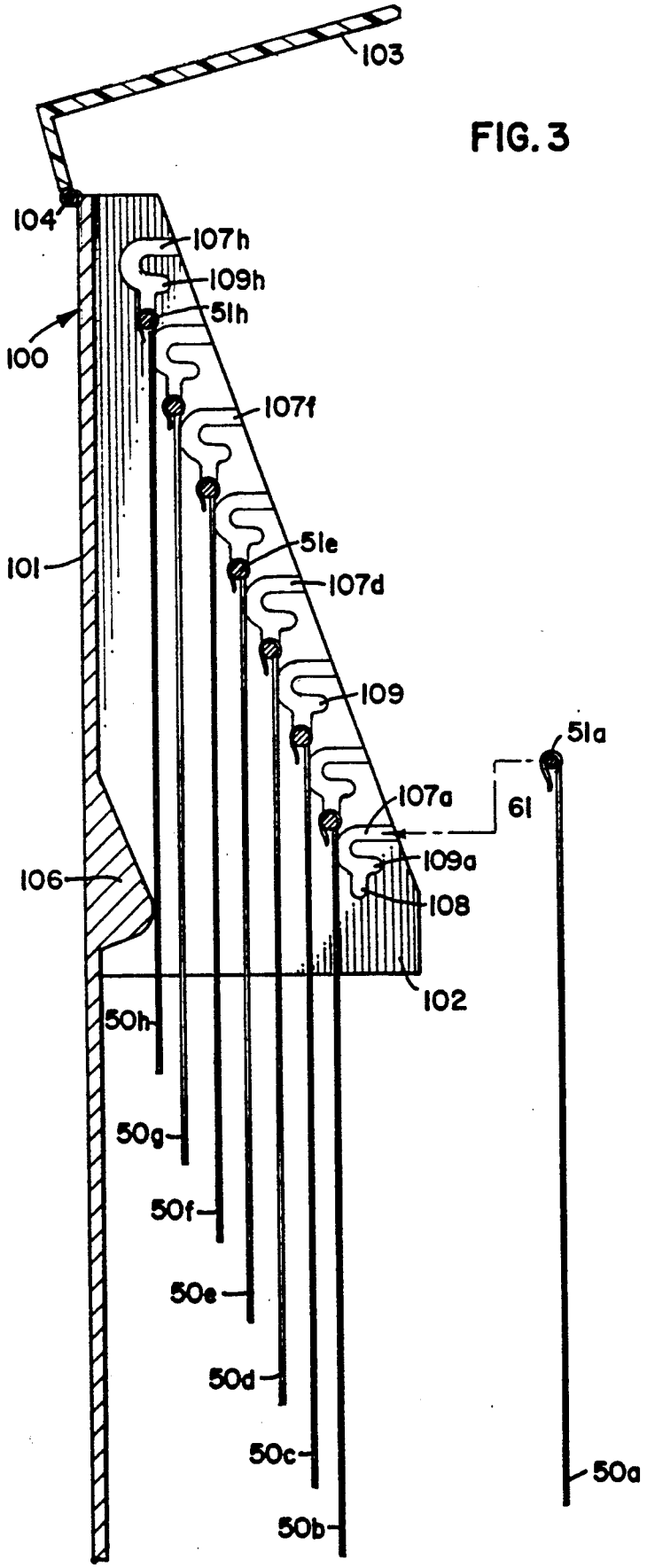
FIG. 3 is a cross-section view of the dispenser taken through line 3—3 of FIG. 1.
Figure 4:
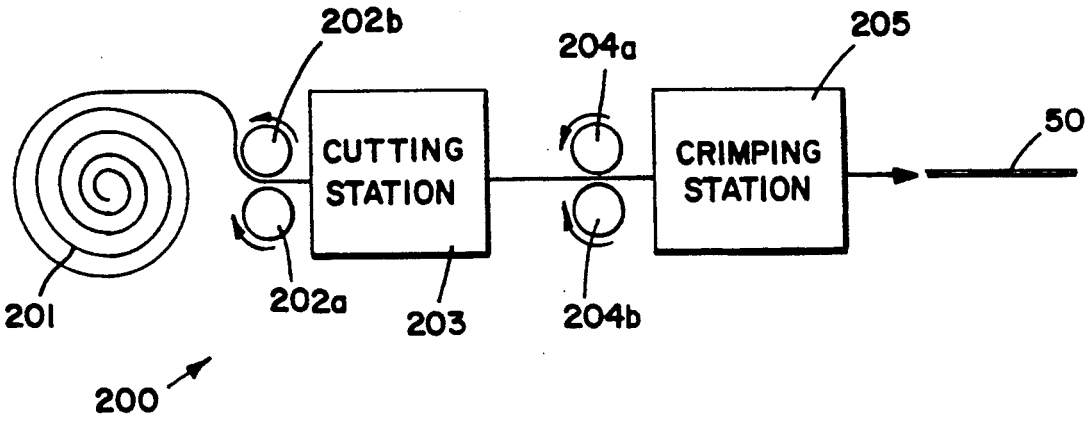
FIG. 4 is a block diagram illustrating the various process steps in a preferred method for fabricating dispensing sheet 50 of FIG. 1.

As mentioned above, the principles of this invention apply to the fabrication of and the dispensing system for a plurality of twist-ties. More specifically, this invention provides for the fabrication and subsequent dispensing of individual selectively removable twist-ties in a setting requiring dispensing of twist-tie closure devices to a plurality of consumers thereby requiring hygienic considerations, and/or the dispensing of a plurality of twist-ties in an environment wherein the orderly removal of individual twist-ties which can be quickly and easily grasped is desired, or required. The individual selectively removable twist-ties will be referred to hereafter as ties for convenience.

A preferred application for this invention is in the dispensing of twist-ties in a grocery produce or other foodstuff type setting. For example, in the dispensing of fresh fruits in a grocery market consumers often bag produce in a clear plastic bag and then desire a closure device so as to minimize or eliminate spillage of the fruit. Such application is typical of only one of enumerable types of applications in which the principles of the present invention can be employed.

In order to facilitate a clearer understanding of the present invention, a detailed description of the fabrication of the twist-tie sheets 50 (best seen in FIG. 3) will be deferred pending a discussion of the sheet 50 and dispenser 100 system 20.

In a preferred application of the invention, the combination of a plurality of cut twist-tie sheets 50, and dispenser apparatus 100, are shown generally in FIG. 1 at 20. Dispenser 100 is comprised of back portion 101, adjoining two oppositely disposed side portions 102*a* and 102*b*. In the preferred embodiment, side portions 102 are mirror images of one another.

Dispenser 100 also includes hinged cover 103, utilizing hinges 104. Such hinges may also be of the integral type, for example a "living hinge" made as part of an injection molding process. Cover 103 might also be hinged at the front of the dispenser 100 rather than the rear. Dispenser 100 further includes key-hole style holes 105 formed through back portion 101 which aid in mounting dispenser 100. Although dispenser 100 is illustrated as having key hole style mounting holes 105, any other number of suitable mounting means might be utilized, such as two-face tape, screws, etc. as those skilled in the art will recognize.

In the preferred embodiment, cover 103 is a transparent plexiglass style material or other suitable high impact plastic such as polypropylene, nylon, high impact styrene and the like. Cover 103 is preferably clear in order to allow consumers to view the ties 52 for selection. Dispenser 100 is fabricated by plastic injection molding or by other well known means.

Side portions 102*a*, 102*b*, as well as back portion 101 are similarly made of plastic but are preferably opaque. Preferably, back portion 101 is a contrasting color from the twist-tie material sheets 50, for ease in selecting the ties 52, to determine if ties 52 remain in the dispenser 100 and for aesthetic purposes. For cost considerations, and if a single injection molding process is utilized, side 102, back 101 and cover 103 may all be of the same color and material and, may be constructed integral to one another.

Those skilled in the art will recognize that although sides 102, back portion 101 and cover 103 are preferably constructed of plastic, any other suitable type of resilient, high impact material might be utilized, with the design considerations being resistance to cracking, temperature, and manufacturing costs among others.

Side portions 102 extend approximately normally from the plane formed by back portion 101. The edge 110 of side portions 102 taper as side portions 102 extend toward the top of dispenser 100. The tapering edge 110 provides for easier insertion of the twist-tie material sheets 50 and provides that each of the slots 107 (described below) defined within side portions 102 are of approximately equal length. However, the exact shape of side portions 102 and edges 110 are a matter of design choice.

Rear portion 101 extends below the ends of side portions 102 to the approximate length of the lowest hanging sheet 50. Such extension 111 affords protection to sheet material 50 from the surface on which dispenser 100 is mounted, as well as from potential contamination, condensation or misting from the rearward direction. Condensation can occur if the dispenser 100 is located in a produce section where cooler air mixes with warmer ambient store air thereby causing condensation. Misting, on the other hand, is routinely utilized in produce sections in order to keep greens fresh and crisp. It is a process wherein water is actually applied as a fine mist to the produce. The extension 111 also provides a similar color background as the sheets 50 for aesthetic reasons. Alternatively, a contrasting background from the sheet 50 may be provided so that consumers can easily discriminate and select an individual tie 52.

As illustrated in FIG. 3, twist-tie sheets 50 hang downward approximately vertically within the dispenser 100, while twist-tie alignment means 106 ensure that the rearward-most sheet 50*h* hangs away from the back portion 101. The positioning of the rearward most sheet 50*h* provides for easier removal of ties 52 from the dispenser 100. Alignment means 106 is preferably an integrally molded portion of back portion 101 and is arranged and configured so as to position sheet 50*h* in an approximately vertical position, while simultaneously being located above the bottom end of sheet 50*h* to avoid hindering removal of twist-ties 52 by individuals.

Still referring to FIGS. 1 and 3, slots 107 are defined in side edges 102. Each slot 107 corresponds to an area in which to hang a sheet 50. In the preferred embodiment, there are eight slots 107, providing for eight sheets 50 of twist-tie material to be inserted into dispenser 100. Slots 107 preferably do not extend through the exterior face of sides 102. The exterior faces being defined as those faces which are not opposing one another. Instead, slots 107 are formed to extend through only a portion of the width of sides 102 (i.e., the slot is defined in the interior, or opposing faces, of sides 102). Those skilled in the art will recognize that the slots 107 might also be formed by extending a portion of the slot walls so as to form a slot on the interior face of sides 102.

The slots 107 are arranged and configured such that rods 51 may be slideably inserted into slots 107 simultaneously in both side portions 102*a*, 102*b*. Slots 107 are further arranged and configured so that rods 51 reside in end portion 108 when the rods 51 are fully inserted into slot 107. The serpentine shape of slots 107 resulting in end portion 108 and middle portion 109 provides advantages discussed further below in connection with the operation of dispenser system 20.

Referring next to FIG. 2, there is illustrated an enlarged portion of a single sheet 50 of cut individually removable twist-tie material. Individual ties 52 are arranged at alternating heights 62*a*, 62*b* to provide for ease of selection. Ties 52 also include first and second perforations 53, 54 as well as side cuts 63. Perforations 53, 54 and side cuts 63 will be described further below in connection with the fabrication of the twist-tie sheets 50. The individual ties 52 are arranged in a side-by-side manner, and are cut longitudinally from first end 62 up to second perforation 53. Individual ties 52 are therefore integral with one another at second end 61. In the preferred embodiment, paper-covered, wire-type twist-ties are utilized for sheets 50. Such tie materials is commonly manufactured by Bedford Industries of Worthington, Minn., designated as uncut ganged ties. In such uncut ganged ties, a wire 55 is embedded into two layers of paper which is then bonded around the wires 55. Typically rolls of this material are at least one thousand feet in length with a width of approximately 63 ties (i.e., 61 wires with paper therebetween and a width for waste on either edge). Each individual tie 52 is preferably 5/32 inch transverse width. Since there are preferably 61 ties, the uncut material is therefore approximately 10 inches wide. After removal of the ties 52, they are approximately four inches long with approximately one inch of material remaining about the rod 51.

The series of perforations 53, 54 are made transversely to the longitudinal axis of individual tie 52 to facilitate the removal of individual ties 52 from the pre-cut sheet 50. The first transverse perforation 54 is performed across the wire 55 of twist-tie 52. Preferably the first perforation 54 does not extend transversely across the entire tie 52. Instead, the first perforation is located in the approximate transverse center of tie 52. The second perforations 53*a*, 53*b* are proximate the first perforation 54 and preferably define where the ties 52 are not further cut longitudinally from one another. By performing two transverse perforations, ease of removal of individual tie 52 is increased, while further ensuring that if referencing of the cutting die 250 (best seen in FIG. 5, described below) is not correctly adjusted, wire 55 will still be perforated, thereby ensuring easy removal of tie 52.

Those skilled in the art will recognize that since a plurality of ties 52 are located on each sheet 50, a series of perforations 53, 54 are performed, not a single perforation. Such series of perforations may occur, however, in one or more steps. For clarity herein, a single tie 52 and its perforations 53, 54 are described.

Referring next to FIGS. 4, 5, 6*a* and 6*b*, a preferred method of fabricating a sheet 50 of ties 52 will be described. The process comprises a series of steps which takes uncut twist-tie material 20 (i.e. rolls of uncut paper with wires 55 running through them), appropriately cuts and perforates the roll 201 to form sheets 50 and the sheets 50 are cooperatively connected to a rod 52.

First, the bulk uncut material 201 is advanced to a cutting station 203. The cutting station includes a first cutting surface 211 to cut a first end 62 of the material and second 212 and third 213 cutting surface to create the first 54 and second 53 perforations. To advance the bulk twist-tie material, a series of counter rotating rollers 202 are used. After cutting/perforating the first sheet 50, the material is advanced and the cutting/perforating process is repeated, wherein the first ends 62 and first 54 and second 53 perforations are formed on a second sheet, while simultaneously the second ends 61 of the first sheet are formed. The formation of the second end 61 occurs due to the cutting die 250 cutting the first end 62 of the uncut material, which then frees the first sheet 50.

Figure 7:
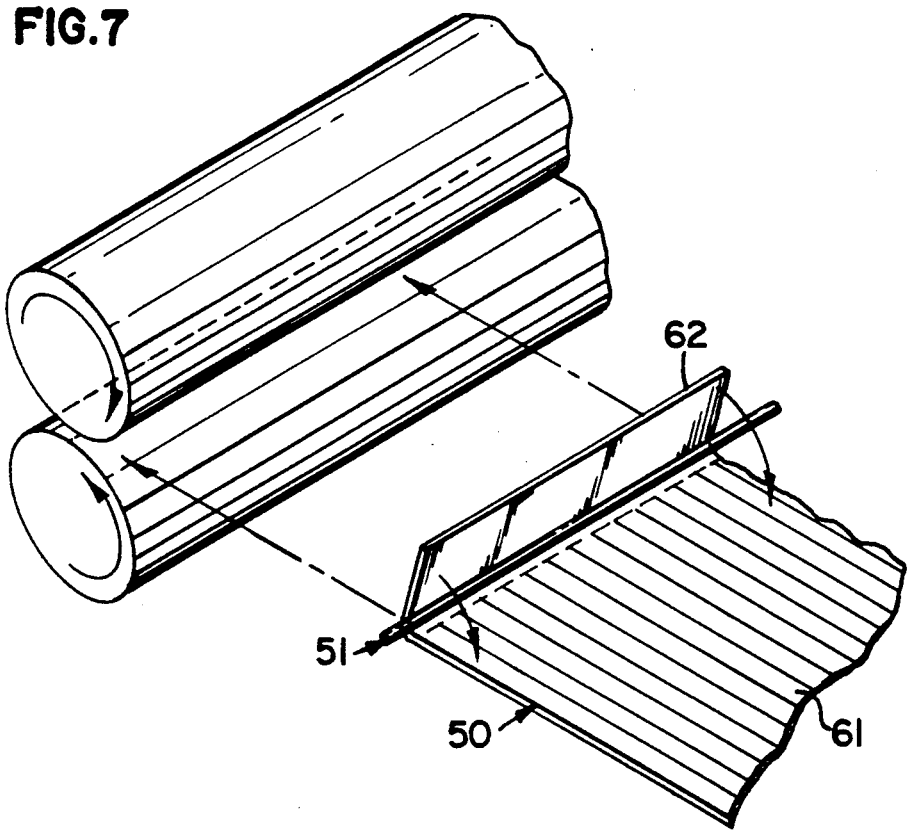
FIG. 7 diagramatically illustrates one embodiment of crimping station 205 of FIG. 4.

The cut sheets 50 are then fed into a crimping station 205 by a second set of counter rotating rollers 204. Crimping station 205 wraps the second end 61 of the sheet 50 about a rigid rod 51, crimping it tightly to the rod 51. Preferably crimping station 205 folds second ends 61 at an angle of approximately forty-five degrees or more, inserts the rod at the vertex of the angle and the sheet is then run through a set of resilient counter rotating rollers (best seen in FIG. 7) which completes the folding process of second end 61 about rod 51. Alternatively a hinged metal plate (best seen in FIGS. 8*a*–8*c*) may be used, whereby the sheet 50 is advanced over the plate, the rod 51 is placed over the sheet at approximately the location of the hinge and the plate is then activated to fold about its hinge to crimp the second end 61.

Preferably, the rod 51 is longer than the sheet 50 is wide. This allows for insertion of the rod 51 into slots 107. Those skilled in the art will recognize that other sheet hanging means might be utilized in lieu of rod 51, such as cardboard and plastic among others.

In the preferred embodiment, sheets 50 have a count of 61 individual ties 52 which are cut along the sides and bottom. As noted above, alternating ties 52 are cut slightly shorter than the others to allow for easy discrimination and removal by consumers. Along the top of the sheet 50, only the wire 55 portion of the tie 52 is cut, with the second perforation 53 removing only a portion of the paper. The remaining paper or plastic portion holds the tie 52 to the sheet 50 until the consumer applies a force to the first end 62, thereby ripping the remaining paper/plastic and releasing the tie 52 from sheet 50.

The top portion 56 of the tie 52 (i.e., that material above the second perforation 53) remains intact about rod 51 upon removal of the tie 52. The top portion 56 that remains about rod 51 may be discarded after removal of the ties 52.

Figures 5, 6A, 6B:
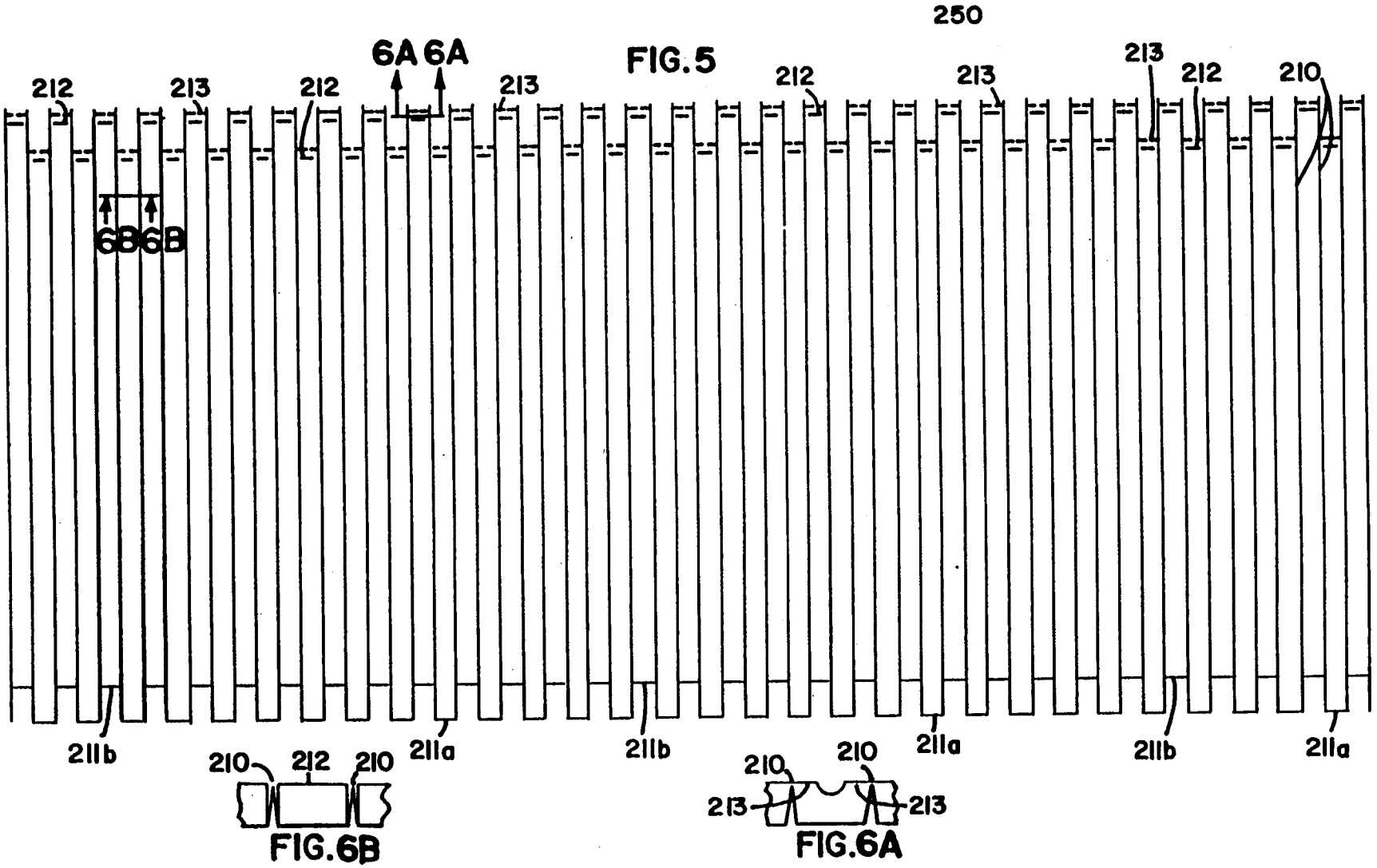
FIG. 5 is a front plan view of a steel rule die illustrating the cutting die pattern utilized at block 203 of FIG. 4.
FIG. 6*a* is a cross section view of a portion of die 150 through line 6*a*—6*a* of FIG. 5.
FIG. 6*b* is a cross section view of a portion of die 150 taken through line 6*b*—6*b* of FIG. 5.

Referring next to FIG. 5, there is illustrated a plan view of a steel rule die 250 which may be utilized in cutting station 203. In FIG. 5, it may be seen that cutting surfaces 210 cut between individual ties 52 along their longitudinal length to form long edges 63. Cutting surfaces 211*a* cut individual ties 52 to longer lengths. Cutting surfaces 211*b* cut alternating ties 52 to shorter lengths. Therefore, cutting edges 211*a* and 212*b* correspond to tie first ends 62*a* and 62*b* respectively. Similarly, it may be seen that cutting surfaces 212 form first perforations 54 while cutting surfaces 213 form second perforations 53*a* and 53*b*.

FIGS. 6*a* and 6*b* illustrate relative cutting widths of cutting surfaces or edges 210, 211. Edges 210 and 211 provide a cut to provide for complete cutting of the tie material from one another, while interruption of the cutting edges 212 and 213 provide merely perforation and not complete cutting.

Those skilled in the art will also recognize that other die cutting methods such as hard tool dies may also be utilized in cutting station 203, among others.

Those skilled in the art will recognize that no effort has been made to correlate each and every cutting surfaces or edges 210 through 213, individual twist-ties 52, or first and second perforations 53, 54, or first and second ends 61, 62, or first height and second height 61*a*, 61*b* of ties 52 illustrated in the accompanying Figures.

In operation, best seen in FIGS. 1 and 3, the fabricated sheets 50 are placed with rod 51 into slots 107 in dispenser 100. The number of sheets 50 inserted into dispenser 100 being a matter of design choice. Hinged cover 103 is then closed thereby readying dispenser system 20 for removal of ties 52 from sheets 50. Due to the resiliency of rod 51, removal of ties 52 may tend to cause a rebound of the rod 51. The rebound is reduced by the shape of slot 107 and rod 51 residing in end portion 108 being "serpentine" and the closing of cover 103 during operation. These precautions ensure that the sheets 50 do not spring out of the dispenser 100. Those skilled in the art will recognize that rods 51 might also be made of a less resilient material (rod 51 is preferably metal with a diameter of approximately 3/32 and a length of 10.5 inches in the preferred embodiment) to avoid rebounding. As the ties 52 are removed from sheet 50, the ties 52 in the sheet 50*b* behind the depleted first sheet 50*a* become visible, thereby ensuring an adequate supply of individual ties 52 for selection by a consumer without complex manipulation, requiring two hands to remove a tie 52, or requiring a container containing a plurality of loose individual ties 52.

Middle portion 109 of slot 107 is provided to further urge rod 51 to remain in slot 107 during dispensing. Middle portion 109 helps reduce the rebound problem described above when a tie 52 is removed with a downward force thereby biasing the rod 51. Middle portion 109 also ensures that if a consumer applies a force directed toward the front or top of the dispenser 100, the rod's 51 upward movement is limited by middle portion 109.

The series of perforations 53, 54 provide for easier removal of ties 52 by requiring less material to be ripped. Further, the perforations 53, 54 allow a slight reference problem with die 250 to still cut wire 55 since second perforations 53 are preferably arranged and configured to cut the wire, 55 if first perforations 54 do not.

It will be appreciated that the principles of this invention apply not only to the twist-tie material described to implement the invention, but also to the method and apparatus in general of implementing a covered twist-ties style dispensing device. While a particular embodiment of the invention has been described with respect to its application for dispensing twist-tie material in a grocery or foodstuffs environment, it will be understood by those skilled in the art that the invention is not limited to such application or embodiment or to the particular dispenser device described herein. It will be appreciated by those skilled in the art that other twist-tie style devices and dispensers that embody the principles of this invention and other applications therefor other than as described herein can be configured within the spirit and intent of this invention. The dispenser and cut sheet format of the twist-tie material described herein is provided only as an example of one embodiment that incorporates and practices the principles of this invention. Other modifications and alterations are well within the knowledge of those skilled in the art and are to be included within the broad scope of the appended claims.

What is claimed is:

1. A method of fabricating a sheet of twist-tie material for dispensing in a dispenser, of the type wherein individual twist ties may be removed, the method comprising the steps of:

(a) advancing a strip of uncut twist-tie material into a cutting station, said strip of uncut twist-tie material having a first leading end, a longitudinal axis, and a plurality of wires oriented substantially parallel to said longitudinal axis;

(b) transversely severing said twist-tie material at said first end in said cutting station;

(c) perforating said twist-tie material longitudinally so as to form longitudinal strips, said perforation located between said wires, wherein at least a portion of said twist-tie material is left uncut such that said longitudinal strips are joined to one another at a predetermined distance from said first end;

(d) perforating said longitudinal strips transversely at a predetermined distance from said first end, wherein said longitudinal strips remain releasably connected at a predetermined distance from said first end and the wire is severed; and (e) advancing said strip of twist-tie material and repeating steps (a) through (d), wherein said severing step at said first end creates a second end of the advanced twist-tie material.

2. The method of claim 1, wherein said cutting station includes a steel rule die.

3. The method of claim 1, wherein said longitudinal perforation step completely cuts the twist-tie material.

4. A sheet of twist-tie material constructed according to the process of claim 1.

5. The method of claim 1, further comprising the step of crimping the first ends of said cut strips of twist-tie material about a rod.

6. The method of claim 5, wherein said crimping step includes advancing said cut strips through counter-rotating rollers.

7. The method of claim 5, wherein said cutting station includes a steel rule die.

8. The method of claim 7, wherein said crimping step includes advancing said cut strips to a hinged plate.

9. A sheet of twist-tie material constructed according to the process of claim 5.

* * * * *